United States Patent [19]

Spriestersbach et al.

[11] Patent Number: 4,660,614

[45] Date of Patent: Apr. 28, 1987

[54] DIE CASTING METHOD

[75] Inventors: Jochen Spriestersbach, Bonn-Alfter; Herbert Woithe, Bonn, both of Fed. Rep. of Germany

[73] Assignees: Maschinenfabrik Müller-Weingarten AG, Weingarten/Württ.; Vereinigte Aluminium-Werke AG, Bonn, both of Fed. Rep. of Germany

[21] Appl. No.: 693,333

[22] Filed: Jan. 22, 1985

[30] Foreign Application Priority Data

Jan. 19, 1984 [DE] Fed. Rep. of Germany ..... 3401715

[51] Int. Cl.[4] ..... B22D 17/00

[52] U.S. Cl. ..... 164/113; 164/136; 164/312

[58] Field of Search ..... 164/113, 119, 136, 121, 164/257, 284, 303, 312

[56] References Cited

U.S. PATENT DOCUMENTS 3,009,218 11/1961 Rearwin .
3,516,480 6/1970 Woltering ..... 164/312

FOREIGN PATENT DOCUMENTS 2539280 3/1977 Fed. Rep. of Germany ..... 164/312
5342013 11/1978 Japan ..... 164/136

OTHER PUBLICATIONS

"Foundary Technology" by P. R. Beeley, pp. 468 and 469.

Brunhuber, "Moderne Druckgussfertigung" (Present--day Die Casting), 1971, Fachverlag Schiele und Schön GmbH, Berlin, Germany, pp. 52–61.

*Primary Examiner*—Nicholas P. Godici
*Assistant Examiner*—G. M. Reid
*Attorney, Agent, or Firm*—Spencer & Frank

[57] ABSTRACT

A die casting process for making castings by means of a horizontally oriented cold-chamber die casting machine comprises the steps of advancing a casting piston in the casting chamber from a starting position for ejecting the molten metal dosage from the casting chamber; and withdrawing the casting piston into the starting position. The withdrawing step includes the step of passing over metal residues adhering to walls of the casting chamber. Subsequent to the withdrawing step and prior to the charging step of a successive cycle, the casting piston is advanced in the casting chamber void of molten metal dosage for ejecting the metal residues by the casting piston from the charging chamber and returning the casting piston into its starting position.

3 Claims, 2 Drawing Figures

DIE CASTING METHOD

BACKGROUND OF THE INVENTION

This invention relates to a method for the die casting of articles, particularly items which are low in gas and oxides and which have a low porosity.

In the work entitled "Moderne Druckgussfertigung" ("Present-day Die Casting") by Ernst Brunhuber (published by Fachverlag Schiele und Schön GmbH, Berlin, Germany) there is described, on pages 57–60 a horizontally arranged cold-chamber die casting apparatus in which the molten material is drawn through a suction pipe by means of a vacuum.

The above process involves the disadvantage that, as the casting piston passes, during its forward stroke, over the suction opening, the metal admitted to the casting chamber is sheared off, whereby between the casting piston and the walls of the casting chamber metal residues appear which may not be entirely removed during the normal working cycle. These metal residues adversely affect an economical performance of the die casting process because they may lead to the jamming of the piston as well as to an increased wear of the piston and the casting chamber.

According to U.S. Pat. No. 3,009,218 the metal residues may be removed by shearing them off the casting piston by means of a sharp edge provided on a closure member of the casting chamber and collecting them in a receiving chamber provided in the closure member. It is a disadvantage of such an arrangement that the shearing off of the residues causes an impermissible wear of the casting piston.

SUMMARY OF THE INVENTION

It is an object of the invention to provide an improved method of the above-outlined type from which the discussed disadvantages are eliminated and thus wear related damages are avoided.

This object and others to become apparent as the specification progresses, are accomplished by the invention, according to which, briefly stated, the die casting process for making castings by means of a horizontally oriented cold-chamber die casting machine comprises the steps of advancing a casting piston in the casting chamber from a starting position for ejecting the molten metal dosage from the casting chamber; and withdrawing the casting piston into the starting position. The withdrawing step includes the step of passing over metal residues adhering to walls of the casting chamber. Subsequent to the withdrawing step and prior to the charging step of a successive cycle, the casting piston is advanced in the casting chamber void of molten metal dosage for ejecting the metal residues by the casting piston from the charging chamber and returning the casting piston into its starting position.

According to the invention, the casting piston has a sharp-edged frontal portion for dislodging metal residues from the walls of the casting chamber. The casting piston further has a chamfered or bevelled part which is oriented rearwardly (that is, towards the piston rod) and which is so designed that the metal residues in the casting chamber are passed over by the piston during the return stroke thereof.

By virtue of a continuous water cooling, the casting piston cools subsequent to ejecting (casting) the metal charge to thus ensure that during the return stroke towards the starting position the casting piston diametrally shrinks which facilitates its passage over the metal residues adhering to the walls of the casting chamber.

Advantageously, the casting piston is charged with a lubricant prior to executing the residue-ejecting additional stroke. It is an advantage of such a step that during the residue-ejecting stroke the lubricant is distributed uniformly on the inner face of the casting chamber.

By providing a thermal insulation of the casting chamber in the zone of the mounting of the suction pipe, an inner cross-sectional variation of the casting chamber along its length is prevented and thus, advantageously, a jamming of the casting piston is avoided and the tendency of residue formation is reduced.

It is a further feature of the invention to cool the casting chamber in the zone of the suction tube mounting in such a manner that the temperature distribution over the length of the casting chamber remains constant (uniform). Such a measure also prevents variation of the inner cross-sectional dimensions of the casting chamber along its length.

According to a further feature of the invention, for the purpose of ensuring uniform temperature conditions in the casting chamber, the latter is formed of an inner and an outer tube (jacket) and in the boundary zone between the two tubes there is provided a two-directional helical groove (channel) through which a heat exchange fluid is driven. It is a further advantage of this arrangement that the inner tube may be a replaceable part exposed to wear.

During the repeated casting process, due to the metal utilization connected therewith, the metal level drops in the casting furnace. Normally, the dosing is performed by a time-dependent control system. This means that a continuous regulation has to be effected in case identical doses are required to take into account a drop in the metal level. When the metal liquid level drops, the required dosing period is lengthened since the predosed metal quantities in the suction tube, predetermined by the metal level, is reduced. The effect of the non-uniform predosing as a function of the metal level is, however, minimized by a further feature of the invention, according to which, in order to avoid inaccuracies in the dosing of the molten metal, the inner volume of the molten material dwelling inside the submerged suction tube has a ratio of at least 1:4 to the inner volume of the overlying suction tube portion.

DESCRIPTION OF THE PREFERRED EMBODIMENTS

Figure 1:
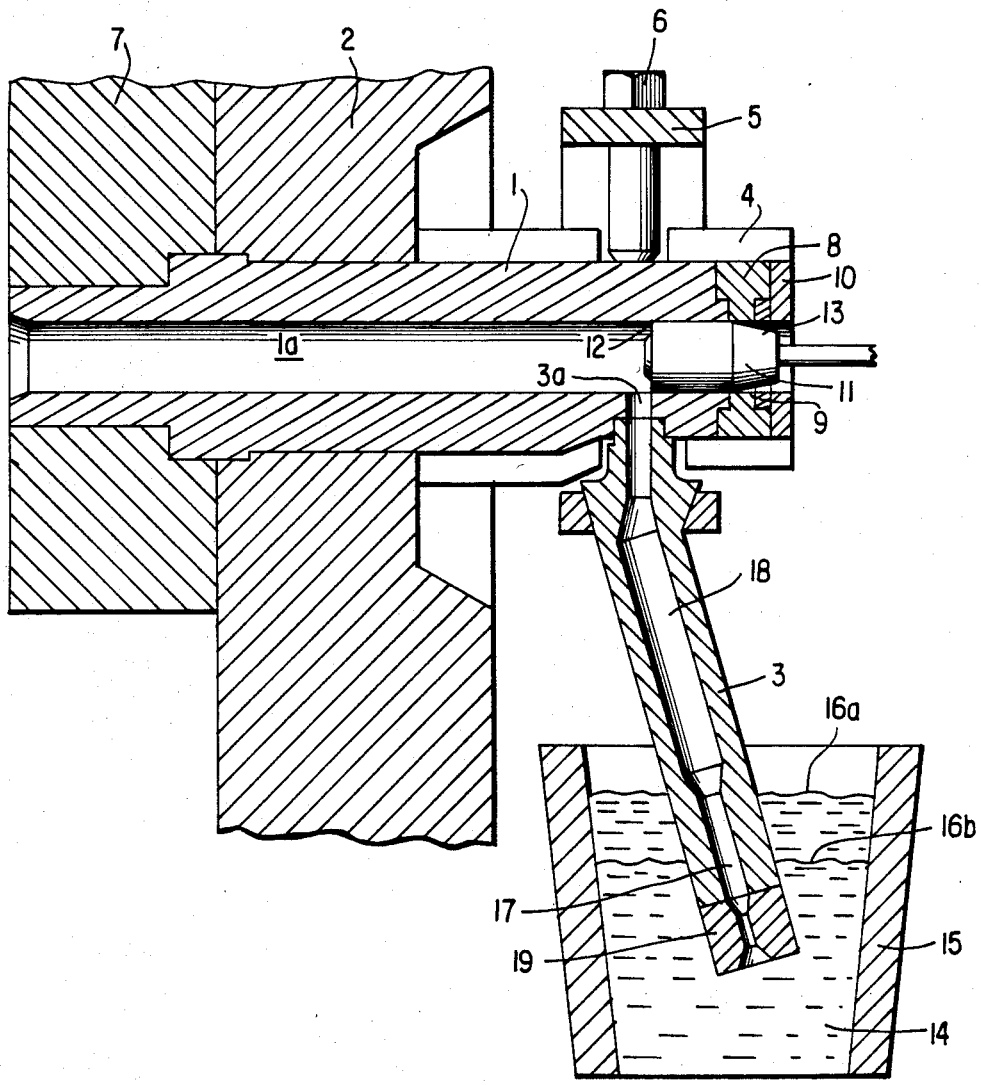
FIG. 1 is a longitudinal sectional view of a preferred embodiment of the invention, illustrating a casting and dosing system for a vacuum fed die casting machine.

Turning now to FIG. 1, there is shown a casting chamber 1 which is supported in a machine frame or shield 2. The casting chamber 1 defines a casting cavity 1*a*. A suction pipe 3 is laterally secured to the casting chamber 1 and is in communication with the casting cavity 1*a* by means of a suction opening 3*a*. At its end adjacent the mount of the suction pipe 3 the casting chamber 1 is provided with a heat exchanger 4. The suction pipe 3 is flanged to the casting chamber 1 by means of a suction pipe support 5 and a securing screw 6 engaging the outer face of the casting chamber 1.

The casting chamber 1 carries at one end a stationary die half 7 and at the other end of the casting chamber 1 there is arranged a closure member 8 in which there is supported a sealing ring 9 by means of an outer closure ring 10.

In the inside of the casting chamber 1 there is arranged, for sliding motion, a casting piston 11 which is illustrated in FIG. 1 in its starting position. At its frontal end oriented towards the cavity of the casting chamber 1 the casting piston 11 has a sharp, circumferential dislodging edge 12 while at its end oriented towards the closure member 8, the casting piston 11 has a tapered terminus 13.

The suction pipe 3 is submerged in the molten metal 14 of the casting oven 15. The suction pipe has two length portions of different inner diameter. The lower portion of the inner volume 17 of the suction pipe 3 is submerged in the metal bath 14. Above the volume 17 there is situated a larger inner volume 18 of the suction pipe 3. The volume 18 is at least four times as large as the volume 17. In case the metal bath level changes from the level 16*a* to the level 16*b* there will occur a decrease in the predosed metal quantities in the zone 17. Such a change, however, is negligibly small because the volume 17, as noted above, is substantially smaller than the volume 18. At the end of the suction pipe 3 there is provided a throttle 19 whose passage volume has no effect on the variation of the dosages.

One cycle of operation, performing a method according to the invention, is as follows: while the casting piston 11 is in its starting position as shown in FIG. 1, molten metal 14 from the casting furnace 15 is drawn by vacuum through the suction pipe 3 and the suction opening 3*a* into the casting cavity 1*a* of the casting chamber 1. Thereupon, the casting piston 11 is displaced towards the left (as viewed in FIG. 1) to execute its forward casting stroke during which the metal is expelled from the casting chamber 1. During this step, metal residues are left on the inner wall of the casting chamber 1, behind the forwardly traveling casting piston 11. Thereupon, the casting piston executes its return motion towards the right. During this occurrence, by virtue of the tapered end portion 13 of the casting piston 11, the latter passes over the metal residues. The casting piston 11, during its return motion, cools considerably and thus undergoes shrinkage of its cross-sectional dimensions whereby its travel over the metal residues is facilitated. As a next step, the casting piston 11 executes, from its position shown in FIG. 1, a forward stroke through the uncharged casting chamber 1. During this step, the end face of the casting piston 11, by virtue of the circumferential sharp edge 12 thereof, dislodges the metal residues from the chamber wall. These residues are being pushed out of the casting chamber 1 by the casting piston 11. Thereupon, the casting piston 11 executes a return motion to assume its original initial position for performing a new cycle.

Figure 2:
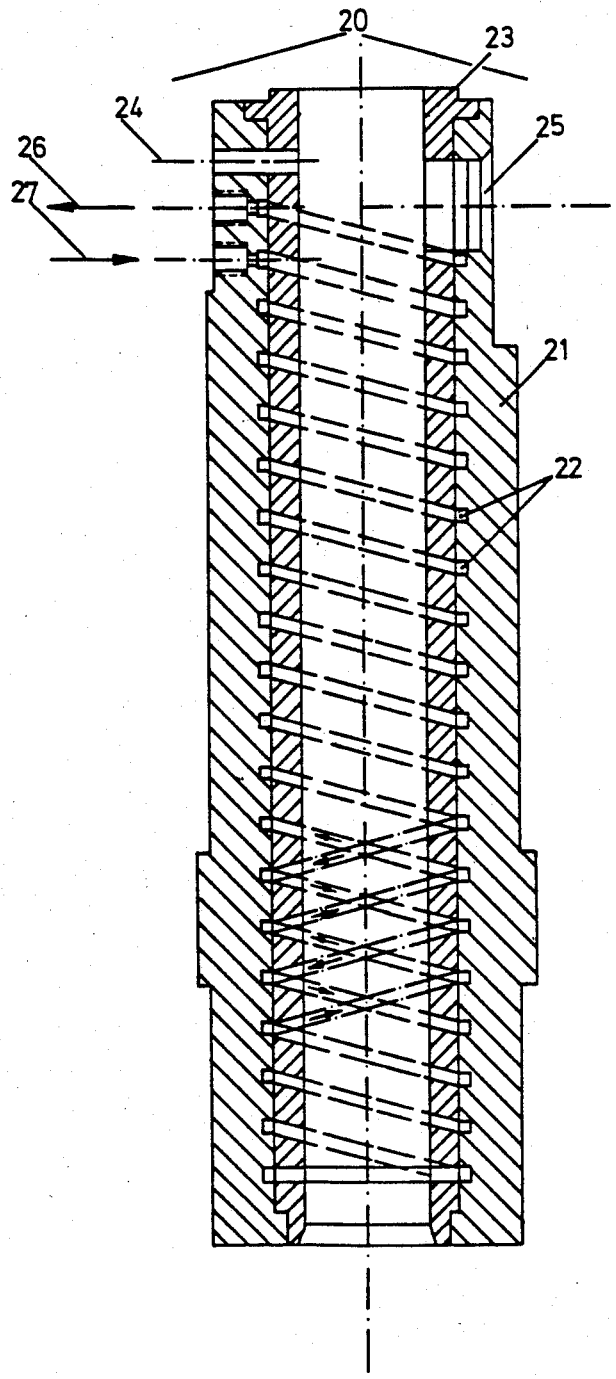
FIG. 2 is a longitudinal sectional view of a component of another preferred embodiment of the invention.

Turning now to FIG. 2, there is shown a modified casting chamber 20 which comprises an outer jacket 21 in which a continuous helical groove 22 is provided. The casting chamber 20 further has an inner jacket 23 whose inner face is exposed to wear and whose material is identical to that of the outer jacket 21. Both the outer and the inner jackets 21 and 23 have aligned radial ports 24 for the admission of a lubricant. Preferably, the lubricant is applied to the casting piston (not shown in FIG. 2) just before executing the residue-dislodging stroke for spreading, during that stroke, the lubricant over the walls of the casting chamber. Diametrically opposite the lubricant port 24 there is provided a dosing opening 25 adapted to receive an end of the suction pipe (not shown in FIG. 2). The continuous helical groove 22 has a two-directional course so that an inflow and outflow of a heat exchange medium is possible at the same end of the casting chamber 20 through inlet 27 and outlet 26, respectively. The direction of the coolant flow is indicated by arrows drawn into the groove 22.

The coolant driven through the groove 22 has an inlet temperature of 200°–300° C. and provides for a uniform temperature distribution along the casting chamber 20. By means of the two-directional helical groove (channel) according to the invention, a highly uniform temperature gradient may be obtained in the casting chamber. In particular, such an arrangement prevents an excessive expansion of the casting chamber in the zone of the suction pipe.

Tests have shown that with a casting chamber cooled according to the invention, the formation of metal residues are substantially reduced to thus further improve the solution of the object of the invention.

It will be understood that the above description of the present invention is susceptible to various modifications, changes and adaptations, and the same are intended to be comprehended within the meaning and range of equivalents of the appended claims.

What is claimed is:

1. In a method of die casting including the cyclical steps of charging a casting chamber with a dosage of molten metal by vacuum; advancing a casting piston in the casting chamber from a starting position for ejecting the molten metal dosage from the casting chamber; and withdrawing the casting piston into said starting position; the improvement wherein the withdrawing step includes the step of passing over metal residues adhering to walls of the casting chamber; further comprising the steps of advancing the casting piston, subsequent to the withdrawing step and prior to a successive charging step, in the casting chamber void of molten metal dosage for ejecting the metal residues by a sharp peripheral edge of the casting piston from the charging chamber and returning the casting piston into its starting position.

2. A method as defined in claim 1, further comprising the step of applying a lubricant to said charging piston subsequent to said withdrawing step and prior to performing the step of advancing the charging piston in the casting chamber void of molten metal.

3. A method as defined in claim 1, further comprising the step of cooling said charging chamber for obtaining a uniform temperature distribution in the charging chamber in a direction parallel to the advancing direction of said casting piston.

* * * * *